United States Patent [19]

Rokop et al.

[11] 3,930,533

[45] Jan. 6, 1976

[54] CONTINUOUS CASTING APPARATUS WITH FLEXIBLE STARTING BAR WHICH IS GEAR-RACK SUPPORTED IN STORAGE POSITION

[75] Inventors: Joseph Rokop, Pittsburgh; Geoffrey W. Hughes, Mc Murray, both of Pa.

[73] Assignee: Rokop Corporation, Pittsburgh, Pa.

[22] Filed: Feb. 27, 1975

[21] Appl. No.: 553,459

[52] U.S. Cl. ..... 164/274; 254/97

[51] Int. Cl.[2] ..... B22D 11/08

[58] Field of Search ..... 164/274, 282; 254/95, 97

[56] References Cited

UNITED STATES PATENTS

| | | | |
|---|---|---|---|
| 1,870,244 | 8/1932 | Elston | 254/95 |
| 3,344,844 | 10/1967 | Reinfeld et al. | 164/274 |
| 3,433,287 | 3/1969 | Greenberger | 164/274 |
| 3,593,776 | 7/1971 | Williamson | 164/274 |

*Primary Examiner*—Robert D. Baldwin

*Attorney, Agent, or Firm*—Brown, Murray, Flick & Peckham

[57] ABSTRACT

A flexible elongated strand-starting member curved lengthwise in a vertical plane has one end formed for temporarily plugging the bottom of a flow-through continuous casting mold. Extending from the opposite end of the starting member along one of its curved sides is a row of rack teeth. Spaced laterally from the mold and at about the same level is a storage housing that has a substantially vertical passage through it for the starting member, while a pair of reversible pinch rolls located about halfway between the mold and storage housing but at a lower level are in a position to grip the lower end portion of the starting member while its upper end is plugging the mold. The rolls withdraw the starting member and a metal strand attached to it from the mold and feed the starting member up into the storage housing passage where a vertical gear engages the rack teeth. An overrunning clutch operatively connected with the gear permits the gear to free wheel while the starting member is being pushed up through the housing by the pinch rolls until the lower end of the strand is past those rolls. The lower end of the strand then is bent down to separate it from the starting member and to straighten it while the starting member is supported by the gear, which is prevented by the clutch from turning in the reverse direction. After the strand has left the pinch rolls, the clutch is driven at a controlled speed in the direction that will allow the lower end of the stored starting member to return by gravity to those rolls so that it can be fed by them back to the mold.

10 Claims, 8 Drawing Figures

CONTINUOUS CASTING APPARATUS WITH FLEXIBLE STARTING BAR WHICH IS GEAR-RACK SUPPORTED IN STORAGE POSITION

In U.S. Pat. No. 3,344,844 continuous casting apparatus of the general type that will be disclosed in this application is shown. In that patent one end of a longitudinally curved rigid starting bar plugs the lower end of a vertical flowthrough casting mold until the mold is filled with molten metal to the desired height. The metal is in the mold solidifies about the adjoining end of the starting bar, which then is moved downwardly away from the mold by pinch rolls, with the solidifying metal forming a continuous metal strand. On emergence from the mold, the metal strand has a thin skin that thickens inwardly by cooling as its distance from the mold increases. To speed up solidification, the strand passes through a water spray area adjacent the mold. The leading end of the moving starting bar is connected to a cable that passes up over a sheave and then down to a power driven drum. The starting bar is supported and guided by a series of opposed rollers. After the rear end of the strand passes between the pinch rolls it then passes between a pair of rolls of a straightener at a higher level. When the strand reaches this point the starting bar is stopped and while it is held in its upper position by the cable the straightening rolls are lowered to break the strand away from the starting bar and to provide a straight portion of the strand that can then be fed by the rolls horizontally along a table, after which the strand can be cut into billets.

One of the objections to the apparatus shown in the patent is that due to the length of the curved starting bar a large number of guide rollers are required to guide it, a number of which are directly below the mold where they will be fouled by molten metal in case there is a break-out at the mold. Another objection is that not only must the rotation of the pinch rolls be controlled in accordance with the rate at which the strand can safely be withdrawn from the mold, but also the rotation of the cable drum must be synchronized with the pinch rolls and that is difficult to do.

It is among the objects of this invention to provide continuous casting apparatus of the general type just discussed, which is simpler and less expensive in construction, in which less damage will occur in case of a break-out at the mold, in which the storing apparatus for the starting member operates automatically during the storing operation, and in which the operation of the storing apparatus does not have to be synchronized with anything.

The preferred embodiment of the invention is illustrated in the accompanying drawings, in which FIG. 1 is a side view of our apparatus, showing the strand about to be disconnected from the starting bar;

FIG. 8 is a horizontal section taken on line VIII—VIII of FIG. 7.

Figure 1:
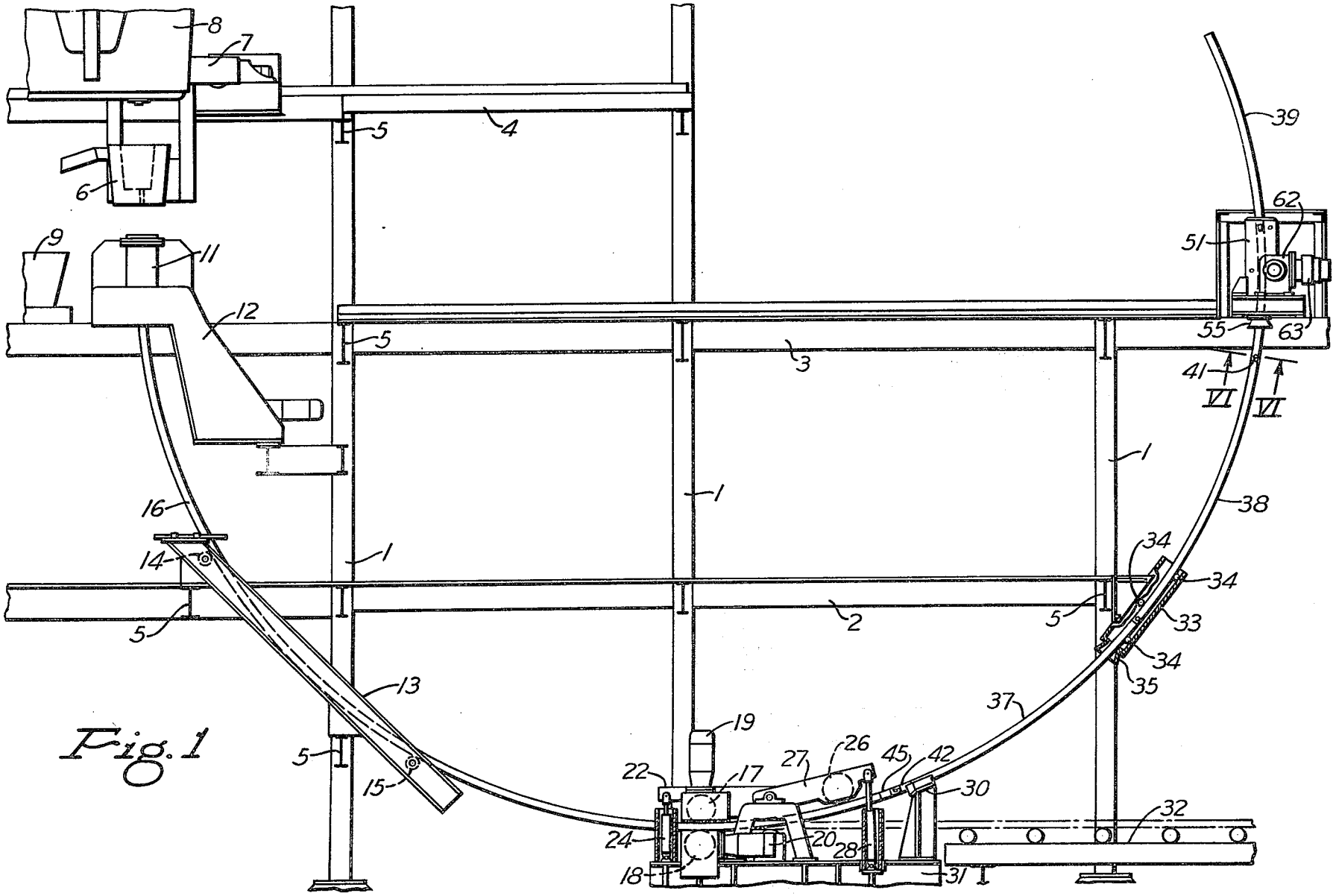

Referring to FIG. 1 of the drawings, a portion of a continuous casting apparatus includes a plurality of vertical columns 1, which are seated on a working floor and support a plurality of vertically spaced horizontal girders 2, 3, 4 and 5 forming working support levels above the floor. The upper horizontal girders 4 support a conventional movable tundish 6, which is suspended from a suitable support carriage 7 that rolls on the girders. A conventional ladle 8 is shown suspended in operative position directly above the tundish. A conventional spill-over box 9 below the level of the tundish is mounted on horizontal girders 3.

Below the tundish 6 there is a vertical flow-through continuous casting mold 11 that is attached to conventional oscillating mechanism 12. Beneath the mold, but at one side of it, there is an inclined trough 13 mounted on a horizontal girder 5 at different levels. The trough extends downwardly and laterally away from the mold. It contains two longitudinally spaced guide rollers 14 and 15 for supporting a metal strand 16 leaving the mold, and also collects the water sprayed onto the strand by a typical spray cooling arrangement, not shown.

Mounted on the floor at the same side of the mold as the trough there is strand-withdrawal apparatus containing a pair of pinch rolls 17 and 18 driven in either direction by reversing motors 19 and 20, respectively. The upper roll 17 is mounted between a pair of arms 22 that are pivoted at one end on the ends of a horizontal shaft 23. At their opposite end the arms are connected to a suitable fluid pressure ram 24 for opening and closing the roll pass. The roll pass is at the bottom of a semicircle extending from the mold down through the roll pass and back up to girders 3. Beside the withdrawal apparatus, at the side opposite trough 13, there is a strand-straightening device consisting of a straightener roll 26 that is supported by a pair of arms 27 also pivotally mounted at one end on shaft 23 between arms 22. At the opposite end of arms 27 there is a suitable ram 28 for swinging the straightener roll up and down.

Just beyond the straightener there is a starting member support bracket 30, which is mounted rigidly on the base 31 of the withdrawal and straightening apparatus. Also a short distance beyond the straightener there is a conventional strand take-off apparatus or conveyor 32, on which the straightened strand is supported as it is driven forward by the pinch rolls toward a conventional billet cut-off mechanism, not shown. Above the conveyor there is an arcuate starting member guide structure supported by a horizontal girder 5. This structure includes an inclined open end hollow guide housing 33 containing in any suitable manner a plurality of guide rollers 34 that are conveniently disposed in spaced apart relation, about as shown in FIG. 1. Encircling the lower end of the passage through this housing there is a downwardly flaring guide ring 35 for the leading end of a strand-starting member.

Figure 6:
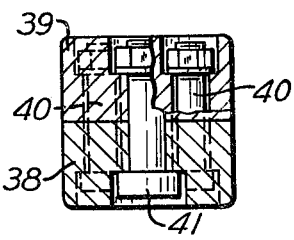
FIG. 6 is a cross section taken on the line VI—VI of FIG. 1.

The longitudinally curved starting member is not a rigid bar as intended in the above-mentioned patent, but has some flexibility in a vertical plane so that it can easily be directed along the desired path and into the apparatus along that path. Preferably, as shown in FIG. 1, the starting material is a flexible bar formed from a plurality of substantially rigid, longitudinally curved links 37, 38 and 39 that are connected end to end in such a manner that they can pivot a limited amount relative to one another in a vertical plane. One way of connecting them is to provide them with laterally overlapping end portions that have a group of registering holes extending through them, in which undersized bolts 40 are disposed as shown in FIG. 6. The bolts connect the links end to end, but, because the bolts do not fill the holes, they permit some pivotal movement of the links on a pivot pin 41 also extending through the overlapping ends of each pair of links. However, bolts 40 maintain the starting bar in a configuration that is curved lengthwise in a vertical plane. Bolted to the end of starting bar link 37 that is closer to the mold is an end member 42 that is provided with a tongue 43 as shown in FIGS. 2 and 3.

Figure 2:
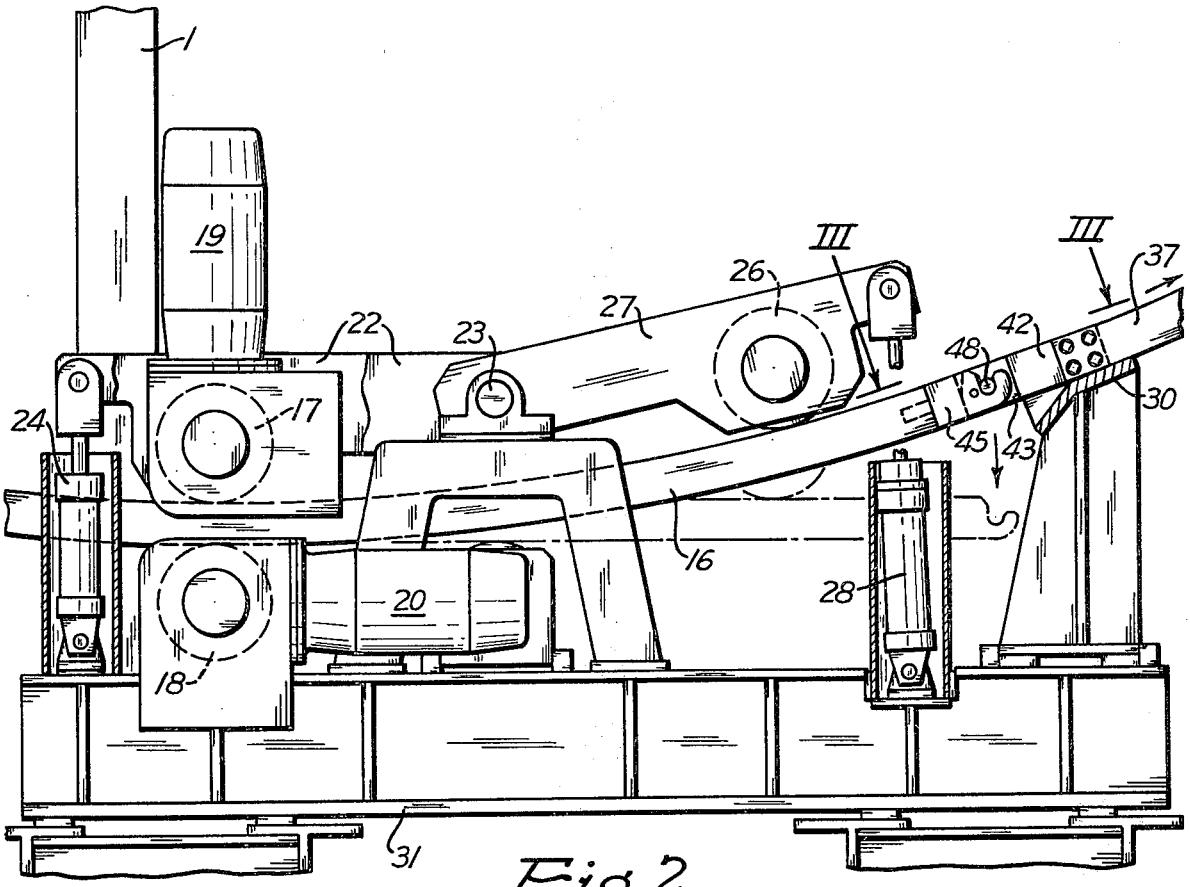
FIG. 2 is an enlarged side view of the pinch rolls and straightener.
Figure 3:
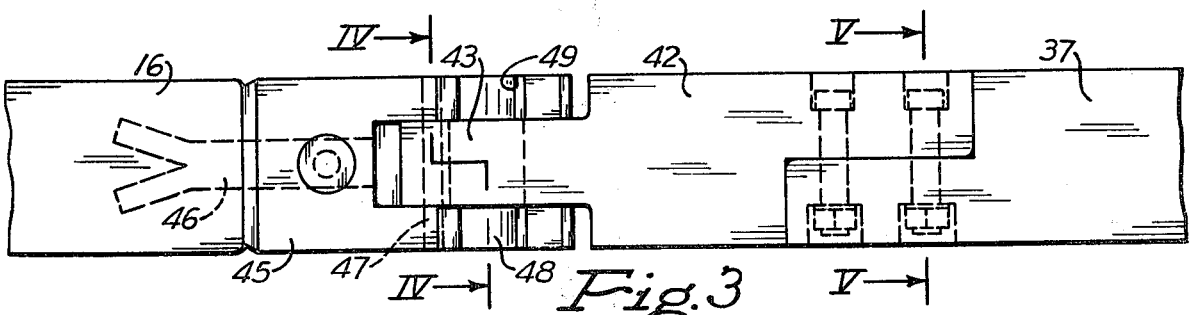
FIG. 3 is an enlarged fragmentary plan view of the connection between the strand and starting bar.
Figure 4:
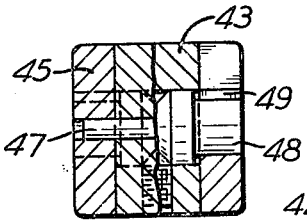
FIGS. 4 and 5 are cross sections taken on the lines IV—IV and V—V of FIG. 3.
Figure 5:
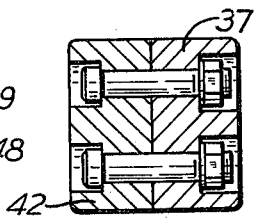

As shown in FIGS. 2 to 4, a head or mold plug 45 that is disposable has a bifurcated inner end that straddles tongue 43. The outer or free end of the plug supports a projecting starting pin 46, around which the molten metal in the lower part of the mold congeals. The plug is attached to the tongue by a shear pin 47 that extends through them. Since this pin is relatively weak, the pull of the starting bar on the plug is taken through an enlarged pin 48 projecting from opposite sides of the tongue into recesses 49 in the inner end of the plug. These recesses open toward the concave side of the starting bar for a purpose that will be explained later. In other words, the inner end of the plug is hooked under pin 48.

Figure 7:
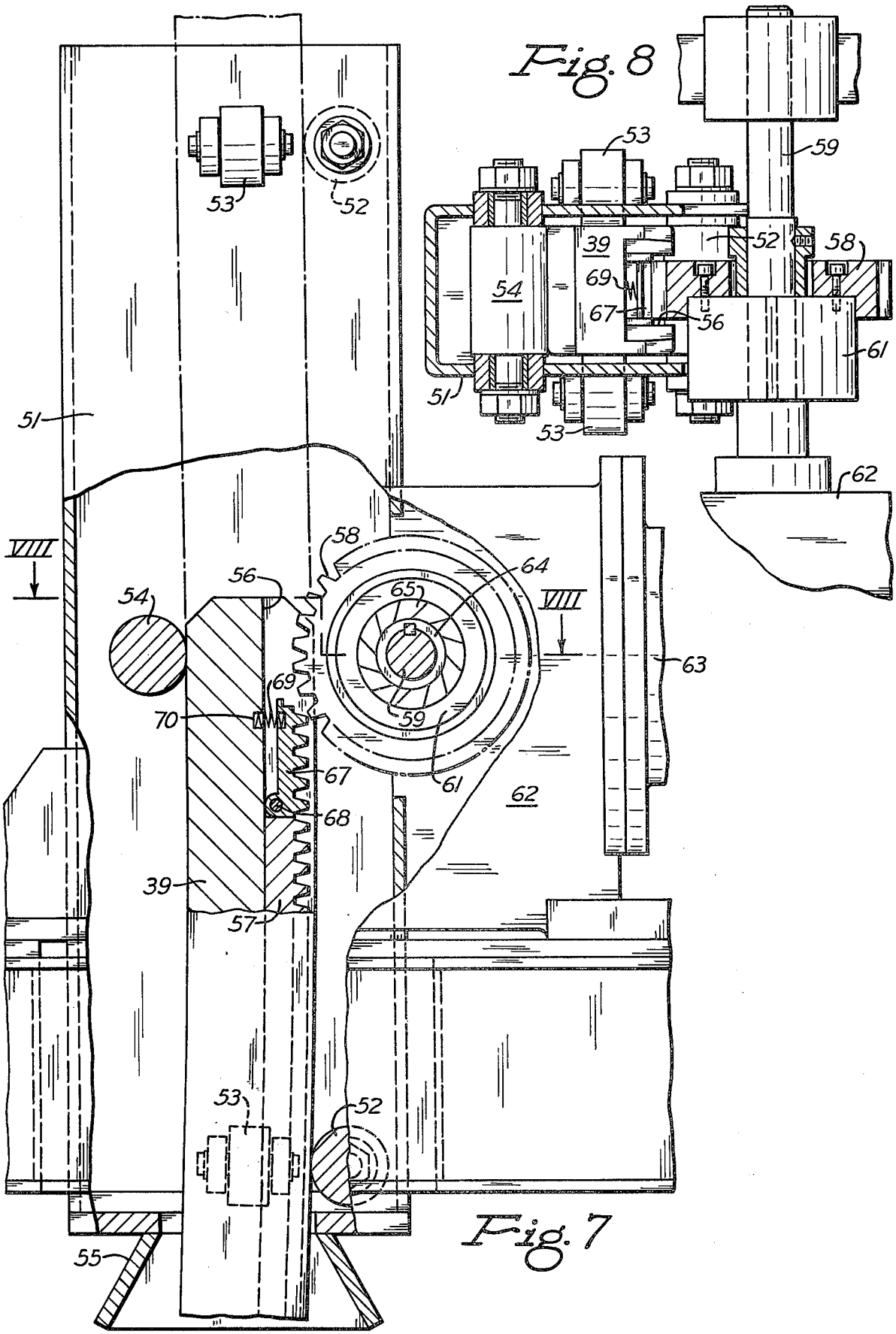
FIG. 7 is an enlarged side view, partly in section, of the storage housing.

When the pinch rolls pull the plug end of the starting bar downwardly away from the mold, the opposite or leading end of the bar is fed upwardly across support bracket 30 and through guide housing 33, into which it is guided by tapered ring 35. As the bar continues to travel upwardly, it enters apparatus for holding the bar while the strand is being disconnected from it and for storing the bar until needed again. As shown in FIGS. 1, 7 and 8, this storing apparatus includes a vertical housing 51 provided with a vertical passage through it for the bar. Inside this passage at top and bottom there are guide rollers 52 for engaging the convex side of the bar, and other guide rollers 53 for engaging the two flat sides of the bar. Another roller 54 about midway of the passage is positioned for engaging the concave side of the bar. A tapered ring 55 guides the bar into housing 51.

End link 39 of the starting bar is provided in its convex side with a slot 56 that extends lengthwise along it as shown in FIGS. 7 and 8. Rigidly mounted in this slot is a long row of rack teeth, most of which can be formed on a long bar 57 that is secured in any suitable manner to the curved inner wall of the slot. These teeth are designed to mesh with a vertical gear 58 rotatable around a horizontal clutch shaft 59 that is rotatably mounted in such a position that the gear projects into the guide housing passage opposite the central guide roller 54. This gear is bolted to one side of the outer race 61 of an overrunning clutch mounted on shaft 59, which in turn is driven from an electric motor 62 through a worm gear in the housing 63 of a speed reducer. The inner race 64 of the clutch is keyed to the shaft. Between the two clutch races there are suitable conventional means 65, such as wedges, that permit the outer race of the clutch to turn the inner race only when the outer race is turned by the gear in a counterclockwise direction as viewed in FIG. 7. While the starting bar is being moved upwardly past the gear by means of the pinch rolls, shaft 59 does not need to be driven because the outer race of the clutch will simply overrun the stationary inner race. Consequently, while the strand is being separated from the starting bar and afterwards, the bar cannot move downwardly through the storage housing because the bar will be supported by the gear, which is stationary because the outer race of the clutch is unable to turn in the reverse or counterclockwise direction relative to the inner race that is held stationary by the worm gear reducer. As a result of this construction, the motor 62 does not have to be, and is not, operated while the pinch rolls are moving the starting bar up through the storage housing at a speed determined by the pinch rolls.

After the lower or trailing end of the starting bar has passed the straightener roll 26, the pinch rolls are stopped and the straightener roll is pulled downwardly by its ram 28 to cause shear pin 47 in the mold plug to break. The plug can be moved downwardly relative to the rest of the starting bar at this time because the recesses 49 in the inner end of the plug allow it to move down away from the large pin 48. In this way, the strand is separated from the starting bar and is bent down to a horizontal position, shown in dotted lines in FIG. 2, that is in line with the conveyor, along which the strand then can be driven by the pinch rolls. The starting bar remains suspended in its elevated storage position supported by gear 58, because the clutch shaft 59 cannot turn until its driving motor is operated.

After the rear end of the metal strand has left the straightener, the pinch rolls are opened by ram 24 and the clutch is driven by motor 61 in the direction that will allow the starting bar to descend by gravity at a controlled speed until its lower end is once again between the pinch rolls. They are then closed upon the bar and reversed so that they will drive the bar back up to the mold. The pinch rolls are driven more slowly than clutch shaft 50 so that there will be no danger of the rolls pulling against gear 58. In other words, the speed of motor 62 does not need to be synchronized with the pinch rolls. Of course, before the starting bar is fed back to the mold, a new plug is attached to the tongue of end member 42 by means of a new shear pin.

Since it was found that when the starting bar was fed up into the storage housing the leading rack teeth sometimes jammed against the gear teeth instead of registering with them, means have been provided for preventing this and assuring that the two sets of teeth will always mesh. This is done by placing in link slot 56 a separate short rack bar 67 at the upper end of the long rack bar 57. This short bar is spaced from the inner wall of the slot and its lower end is pivotally connected to the starting bar by a transverse pin 68. Also, the upper or free end of the short rack bar normally is held in alignment with the long rack bar by means of a strong coil spring 69 seated in a socket 70 in the starting bar behind the short rack bar. With this arrangement, if the leading tooth of the rack does not enter between two teeth of the gear but tends to jam against one of them, the pressure of the upward movement of the starting bar will cause the pivoted rack bar to swing inwardly against the compression of the spring so that the leading rack tooth can slip by the interfering tooth of the gear and then snap back between two gear teeth where it belongs. The rack teeth then are in proper engagement with the gear and will move upwardly past it without interference from it. This is an important feature of this invention.

If the starting bar were a one-piece, so-called "rigid" bar its ends still would tend to spread apart, due to its weight and length. To prevent that, many guide rollers are needed as shown in U.S. Pat. No. 3,344,844, and they add considerably to the cost of the apparatus. Furthermore, some of them have to be located directly below the mold where they are in the path of molten metal in case the metal breaks out of the mold. With our flexible starting bar, on the other hand, only a few guide rollers are required because it is easy for them to swing the bar links on their pivots to direct the links into their proper path. For the same reason it is unnecessary to locate guide rollers close to the mold and in the path of break-out metal.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. Continuous casting apparatus, comprising a flow-through casting mold, an elongated strand-starting member curved lengthwise in a vertical plane and having one end formed for temporarily plugging the bottom of the mold while molten metal therein adheres to said member, said member being provided with a row of rack teeth extending along one side from its opposite end, a storage housing spaced laterally from the mold and having a substantially vertical passage therethrough for said member, a pair of reversible driven pinch rolls located about half way between the mold and storage housing and at a lower level in a position to grip the lower end portion of said starting member while its upper end is plugging the mold, said rolls being rotatable in a direction to withdraw the starting member and an attached metal strand from the mold and feed said member up into said housing passage, a vertical gear projecting into one side of said housing for engagement by said rack teeth, an overrunning clutch operatively connected with the gear and permitting it to free wheel in one direction as said rack teeth move upwardly across the gear until the lower end of the metal strand has passed said pinch rolls, driving means for controlling rotation of the clutch in the opposite direction by the starting member when said member is disconnected from the strand, the driving means including means for preventing rotation of the clutch in said opposite direction by said gear while the driving means is not operating, and means for bending the lower end of the strand down to separate it from the starting member and straighten the portion of the strand between said member and rolls while said member is supported by said gear, said clutch being rotatable by said driving means at a controlled speed in said opposite direction to allow the lower end of the stored starting member to return by gravity to said pinch rolls after the strand has left said rolls, whereupon the starting member can be fed by the pinch rolls back up to the mold.

2. Continuous casting apparatus according to claim 1, in which said clutch includes inner and outer races with clutching means between them, and means rigidly connecting the outer race to one side of said gear, said driving means including a shaft rigidly connected to said inner race, and means for rotating the shaft only in said opposite direction.

3. Continuous casting apparatus according to claim 1, in which said bending means include an arm pivoted at one end on a horizontal axis above the path of movement of said starting member, and means for swinging the opposite end of the arm down to push the lower end of the strand downwardly.

4. Continuous casting apparatus according to claim 1, in which the strand end of said starting member is provided with a disposable mold plug having an inner end laterally overlapping the adjoining portion of said member, and a shear pin extending through said plug end and overlapped portion of the starting member and adapted to be sheared off by downward pressure of said bending means against the plug.

5. Continuous casting apparatus according to claim 4, in which said overlapped portion of the starting member has a lateral projection, and the inner end of said plug is provided with a recess receiving said projection, said recess opening upwardly when the plug is in position to be forced down by said bending means.

6. Continuous casting apparatus according to claim 1, including a roller in said storage housing passage opposite said gear for holding the teeth of the starting member against the gear.

7. Continuous casting apparatus according to claim 1, in which several of said rack teeth nearest said opposite end of the starting member project from the side of a bar that is pivoted at its inner end to said member on a transverse axis, and a spring is disposed between said bar and the portion of the starting member behind it, whereby said gear can swing the outer end of said bar backward against the resistance of said spring until the rack teeth mesh with the gear teeth.

8. Continuous casting apparatus according to claim 1, in which said starting member includes a plurality of substantially rigid curved links pivoted together end to end on parallel horizontal axes for limited pivoted movement relative to one another.

9. Continuous casting apparatus according to claim 1, in which said controlled speed of said clutch is faster than said pinch rolls are driven in feeding the starting member toward the mold.

10. Continuous casting apparatus according to claim 1, in which said starting member is formed from a plurality of curved links pivoted end to end for limited swinging in a vertical plane relative to one another.

* * * * *